US011819082B2

(12) United States Patent
Lacy et al.

(10) Patent No.: US 11,819,082 B2
(45) Date of Patent: Nov. 21, 2023

(54) BREAKAWAY CLASP FOR HEADWEAR

(71) Applicant: Sunday Afternoons, Inc., Talent, OR (US)

(72) Inventors: Robbin Lacy, Talent, OR (US); Joey Fallon, Ashland, OR (US); Russell Hodgdon, Talent, OR (US); Joseph Zachariasen, Talent, OR (US)

(73) Assignee: SUNDAY AFTERNOONS, INC., Talent, OR (US)

( * ) Notice: Subject to any disclaimer, the term of this patent is extended or adjusted under 35 U.S.C. 154(b) by 853 days.

(21) Appl. No.: 16/570,999

(22) Filed: Sep. 13, 2019

(65) Prior Publication Data

US 2020/0022445 A1 Jan. 23, 2020

Related U.S. Application Data

(63) Continuation of application No. 15/382,455, filed on Dec. 16, 2016, now Pat. No. 10,448,694.

(60) Provisional application No. 62/269,722, filed on Dec. 18, 2015.

(51) Int. Cl.
*A42B 7/00* (2006.01)
*A42B 1/02* (2006.01)

(52) U.S. Cl.
CPC . *A42B 7/00* (2013.01); *A42B 1/02* (2013.01)

(58) Field of Classification Search
CPC .. A42B 7/00; A42B 1/02; A42B 11/04; A42B 3/326; A42B 3/08; A42B 3/142; A42B 1/045; Y10T 24/4088; Y10T 24/4091; Y10T 24/4093
See application file for complete search history.

(56) References Cited

U.S. PATENT DOCUMENTS 348,871 A * 9/1886 Wales ..... A41F 1/006 24/561
745,884 A * 12/1903 Morton ..... A44B 11/04 24/198
1,180,035 A * 4/1916 Hausen ..... A41F 11/04 24/474
1,860,170 A * 5/1932 Bronson ..... A44B 11/04 24/198
1,914,301 A * 6/1933 Schottenfels ..... A41F 1/006 450/83
2,039,174 A * 4/1936 Lewis ..... A42B 7/00 2/175.1
2,040,958 A * 5/1936 Schottenfels ..... A41F 11/02 2/268
2,099,199 A * 11/1937 Devendor ..... A44B 11/04 2/268
2,140,164 A * 12/1938 Moffatt ..... A41F 1/006 24/200
2,212,862 A * 8/1940 Hirsh ..... A44B 11/04 24/336

(Continued)

*Primary Examiner* — Heather Mangine
*Assistant Examiner* — Raquel M. Weis
(74) *Attorney, Agent, or Firm* — McCoy Russell LLP

(57) ABSTRACT

Embodiments are disclosed for a clasp including a top loop having a catch end, a bottom loop coupled to the top loop, the catch end positioned above the bottom loop at a first side of the clasp, and a depression at a second side of the clasp, opposite the first side, a thinnest part of the second side of the clasp being formed by the depression.

18 Claims, 6 Drawing Sheets
(5 of 6 Drawing Sheet(s) Filed in Color)

(56) References Cited

U.S. PATENT DOCUMENTS

RE21,619 E * 11/1940 Schottenfels ..... A41F 11/02 24/198
2,340,872 A * 2/1944 Thomas ..... A42B 3/12 2/6.6
2,664,610 A * 1/1954 Hannemann ..... B64D 17/38 24/579.11
3,121,270 A * 2/1964 Van Den Broek et al. ..... B65D 63/16 24/312
3,161,931 A * 12/1964 Zif ..... A44B 11/04 24/200
3,206,816 A * 9/1965 Vilcins ..... A44B 11/02 24/200
3,217,714 A * 11/1965 Silverman ..... A41F 1/006 450/82
3,314,078 A * 4/1967 Marchello ..... A42B 3/08 2/421
3,408,708 A * 11/1968 Hawie ..... A41F 11/04 24/478
3,461,876 A * 8/1969 Miller, Jr. ..... A61B 17/122 251/10
3,529,329 A * 9/1970 Burleson ..... A41F 11/02 24/200
3,624,813 A * 11/1971 Gaylord ..... B64D 17/22 24/603
3,766,925 A * 10/1973 Rubricius ..... A61B 17/122 606/120
3,813,734 A * 6/1974 Schauweker ..... A44B 11/02 24/200
4,866,818 A * 9/1989 Thompson ..... B65D 33/1675 24/543
5,177,837 A * 1/1993 Rekuc ..... A44B 11/00 24/200
5,432,985 A * 7/1995 Bernart ..... A44B 11/04 24/265 AL
5,598,608 A * 2/1997 Naslund ..... B65D 33/1675 24/30.5 R
5,706,560 A * 1/1998 Anscher ..... A45F 5/02 24/30.5 R
5,899,791 A * 5/1999 Fildan ..... A41F 1/006 450/82
5,930,841 A * 8/1999 Lampe ..... A42B 3/00 2/421
6,179,687 B1 * 1/2001 Lee ..... A41F 15/002 450/88
D447,091 S * 8/2001 Fildan ..... D11/210
6,385,819 B1 * 5/2002 Ingold ..... A63C 11/2228 2/60
6,435,940 B1 * 8/2002 Fildan ..... A41F 1/006 450/86
7,100,249 B2 * 9/2006 Hurn ..... A44B 11/04 24/199
7,140,080 B2 * 11/2006 Fildan ..... A44B 11/04 450/86
7,234,995 B2 * 6/2007 Fildan ..... A44B 11/04 24/265 AL
7,958,604 B2 * 6/2011 Wong ..... B65D 5/5028 206/478
10,448,694 B2 * 10/2019 Lacy ..... A42B 1/02
2002/0077029 A1 * 6/2002 Fildan ..... A44B 11/04 450/86
2012/0094576 A1 * 4/2012 Tedder ..... A41F 15/002 450/86
2015/0150328 A1 * 6/2015 Knight ..... A42C 5/04 2/175.1
2017/0290389 A1 * 10/2017 Copeland ..... A42B 3/0406

* cited by examiner

BREAKAWAY CLASP FOR HEADWEAR

CROSS-REFERENCE TO RELATED APPLICATIONS

The present application is a continuation of U.S. patent application Ser. No. 15/382,455, entitled "BREAKAWAY CLASP FOR HEADWEAR", and filed on Dec. 16, 2016. U.S. patent application Ser. No. 15/382,455 claims priority to U.S. Provisional Patent Application No. 62/269,722, entitled "BREAKAWAY CLASP FOR HEADWEAR", and filed on Dec. 18, 2015. The entire contents of each of the above-identified applications are hereby incorporated by reference for all purposes.

FIELD

The disclosure relates to headwear or other accessories including a breakaway clasp.

BACKGROUND

Headwear, such as wide-brimmed hats, may include chin straps to secure the hat on a user's head and/or allow the hat to hang on a user's back. While chin straps may be adjustable to change a tightness around the user's chin/neck, some chin straps may be attached to the hat in a permanent or semi-permanent manner (e.g., via stitching, gluing, and/or other coupling mechanisms).

SUMMARY

Embodiments are disclosed for headwear comprising a chin strap that is removably coupled to the headwear via a breakaway clasp. The breakaway clasp may be coupled to the headwear in a first location and coupled to the chin strap in a second location. The breakaway clasp may be configured to break and/or otherwise disengage the chin strap from the headwear responsive to an application of a threshold amount of force to the breakaway clasp.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The disclosure may be better understood from reading the following description of non-limiting embodiments, with reference to the attached drawings, wherein below.

DETAILED DESCRIPTION

As described above, headwear may include mechanisms for securing to a wearer's head and/or to otherwise prevent the headwear from being removed from the wearer. For example, a chin strap may extend from one location of a crown or brim of a hat, around a wearer's jaw/chin, and back to an opposing location of the crown or brim of the hat. In this way, if wind, rain, or another strong force pushes the hat backward off of the wearer's head, the chin strap may catch on the wearer's chin or neck, preventing the hat from flying off of the wearer entirely. The chin strap may also be tightened under the wearer's chin in order to ensure that the hat remains at a desired position on the wearer's head in the presence of weaker forces.

While the above-described chin strap or other securing mechanism may help prevent headwear from being knocked off of a wearer, there may be situations where the wearer may prefer a quick-release option (e.g., in the presence of very strong forces or when the strap becomes uncomfortable). For example, the quick-release option may provide a safety feature to allow the strap to become unclasped in the presence of excess forces (e.g., if the chin strap is caught on a wearer's neck and exerting uncomfortable forces thereon). The quick-release option may also allow a parent to quickly and easily release the headwear from a child who no longer desires to wear the headwear or who is experiencing discomfort with the headwear. The disclosure provides a breakaway clasp that maintains structural integrity to secure headwear under a first range of forces and/or forces at a first range of angles, and breaks away under a second, higher range of forces and/or forces at a second range of angles. For example, the range of forces at which the clasp maintains structural integrity may be different for different angles at which such forces are applied. While the examples described herein will largely be presented with respect to a chin strap or other headwear securing mechanism for illustrative purposes, it is to be understood that the described features may be utilized for a clasp in any environment. For example, the clasps described herein may be included in a belt, harness, band (e.g., watch band, head band, etc.), and/or other suitable product without departing from the scope of this disclosure.

Figure 1:
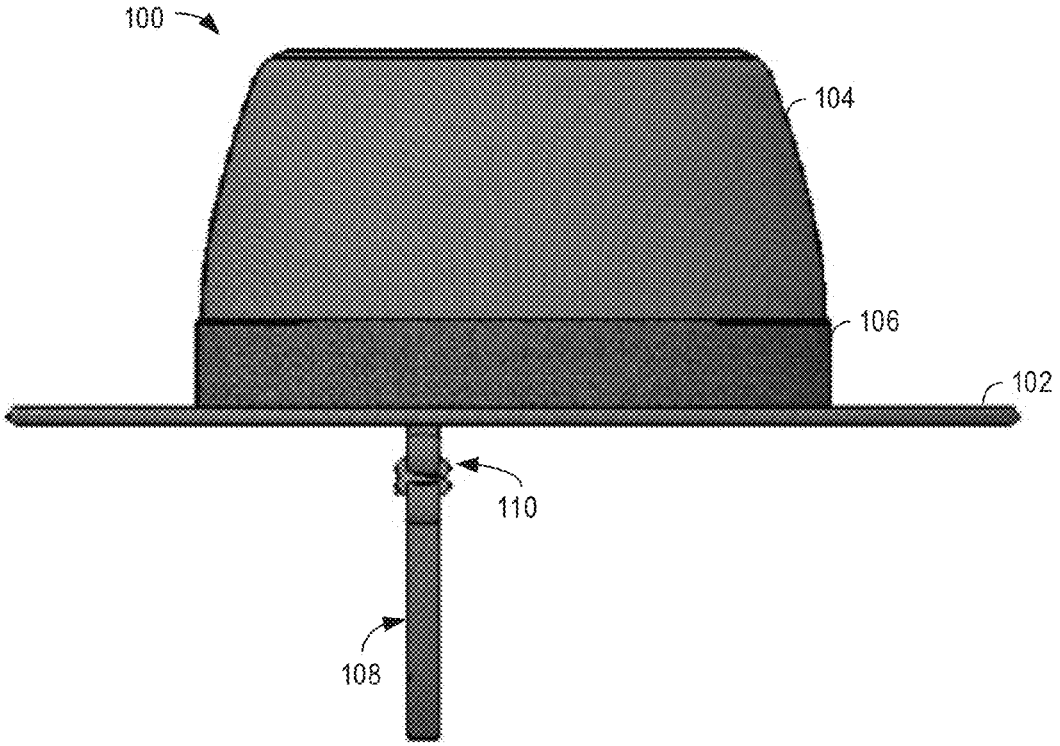
FIG. 1 shows a side view of an example headwear including a clasp in accordance with one or more embodiments of the present disclosure.

FIG. 1 shows a side view of an example headwear, such as a hat 100. As illustrated, headwear 100 includes a brim 102 and a crown 104. The brim 102 may be attached to, extend from, and/or otherwise be carried by the crown 104 (e.g., a bottom portion of the crown 104). The crown may comprise a cap configured to extend over a top of a wearer's head. In some embodiments, the crown 104 may include a plurality of panels extending around a circumference of the crown and intersecting at a central region. In other embodiments the crown 104 may be formed of a single panel or piece of fabric (e.g., a unibody construction) forming any suitable hat body shape. In some embodiments, each panel (or the entirety of the crown/visor) may include the same type of fabric or other material. In other embodiments, one or more panels (or the crown) may include a different type of material than the other panels (or the visor). As illustrated in FIG. 1, the crown may include one or more external peripherals, such as band 106, which may serve aesthetic and/or utility (e.g., providing a tightening mechanism to assist in securing the hat to a wearer's head) purposes.

A chin strap 108 may extend from the brim 102 and/or the crown 104. For example, the chin strap 108 may be integrated with and/or coupled/attached to a bottom surface of the brim 102, an interior surface of the crown 104, an intersection at which the brim and crown meet, and/or any other suitable location. As the brim and/or crown of the hat 100 forms a substantially circular structure, the chin strap may be coupled and/or attached to the hat at two positions along a circumference of the crown and/or brim. For example, a first position or location at which the chin strap is coupled and/or attached to the hat may be directly opposite a second position or location at which the chin strap is coupled and/or attached to the hat (e.g., approximately 180 degrees separating the two locations/positions). As used herein, the terms secured to, coupled to, and/or attached to may encompass any suitable securing mechanism, including but not limited to stitching, gluing, grommets, magnets, and/or any other suitable mechanical or chemical fastening mechanism.

In other examples, the two positions or locations may be on opposite sides of the hat (e.g., such that the positions are on opposite sides of a wearer's head/face while the hat is worn), and not 180 degrees apart. For example, the two positions or locations may be positioned toward a rear of the hat, and separated by less than 180 degrees (e.g., within a range of 30 to 179 degrees) when measured across the rear of the hat. As another example, the two positions or locations may be positioned toward a front of the hat, and separated by less than 180 degrees (e.g., within a range of 30 to 179 degrees) when measured across the front of the hat. As used herein, the terms opposing positions or opposing locations may refer to any of the example positions described above.

Figure 2:
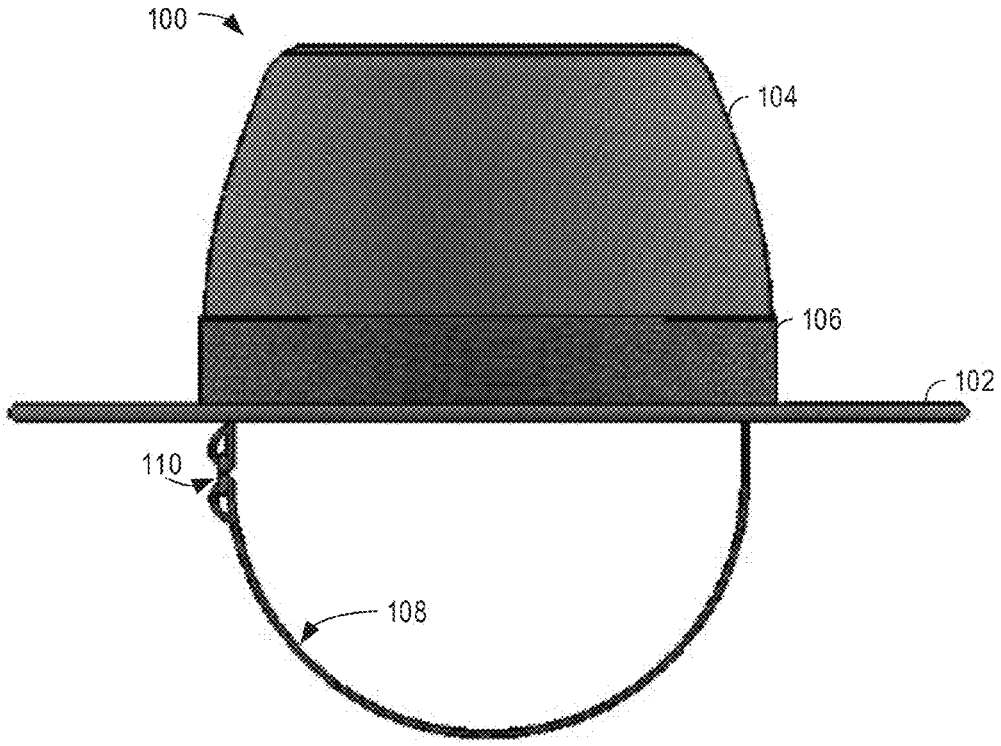
FIG. 2 shows a front view of the example headwear of FIG. 1 in accordance with one or more embodiments of the present disclosure.

The chin strap 108 may include a single strap of material (e.g., a same material as used in another region of the hat, an elastomeric material, a fabric and/or self-fabric, a cord or collection of cording, a string or collection of strings, lacing, and/or another suitable material or composite material) that is interrupted by a clasp 110 and/or two strap portions of material that are joined via the clasp 110. In the two strap portions example, each strap portion may include two terminal ends opposite one another along a longitudinal axis of the strap portion (e.g., along a length/longest dimension of the strap portion). A first terminal end of each strap portion may be coupled and/or attached to a different one of the two opposing locations along the circumference of the brim/crown. A second terminal end of each strap portion may be coupled and/or attached to the clasp 110. For example, the second terminal ends of the strap portions may include a loop of fabric. The clasp 110 may include two loops, one or both of which may be closed and one or both of which may be open. The loop of fabric at each of the second terminal ends of the strap portions may enclose a top or bottom portion of a respective one of the loops of the clasp 110. An example of this construction is shown in FIG. 2, which illustrates a front view of hat 100 of FIG. 1. In an example where at least one of the loops of the clasp 110 is open, the wearer may freely insert or remove the top/bottom portion of that loop (e.g., a leg forming a top or bottom surface of the loop) into an opening within the loop of a respective terminal end of one of the strap portions of the chin strap 108. The connection of the straps to the clasp will be described in more detail below with respect to FIG. 4.

In the single strap example, the strap may include two terminal ends, each of which is coupled and/or attached to the above-described opposing locations along a circumference of the brim and/or crown. In such an example, the clasp may include two closed loops joining two sections of the strap, such that a wearer may not be able to separate the two sections of the strap without applying enough force to break the clasp. In another embodiment of the single strap example, the strap may include two terminal ends, one or both of which is either 1) coupled and/or attached to the above-described opposing locations along the circumference of the brim and/or crown, or 2) coupled and/or attached to a loop of fabric, metal, or other material that is coupled and/or attached to the above-described opposing locations along the circumference of the brim and/or crown. In this way, only one or none of the terminal ends may extend from the hat directly. In one example, a small sewn loop along the sweatband of the hat may attach directly to a chin strap clip.

Figure 3:
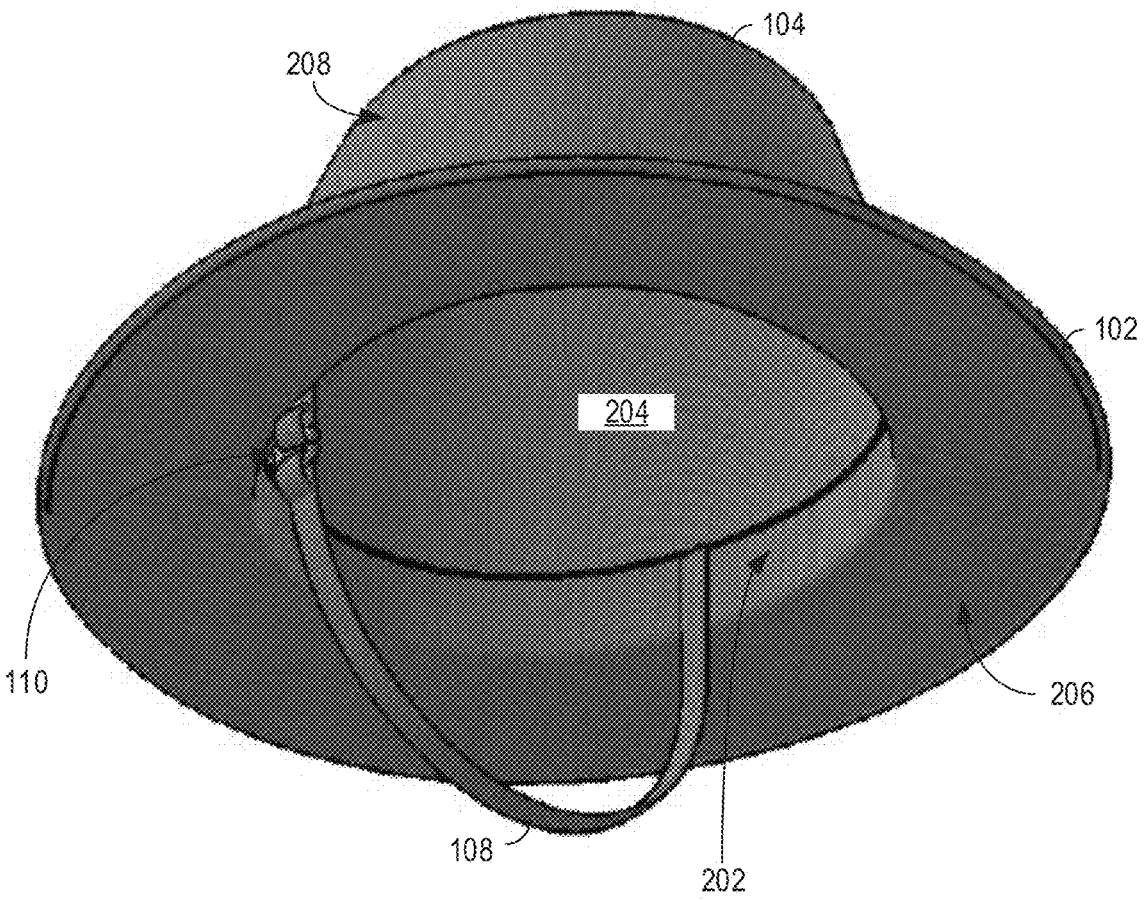
FIG. 3 shows a bottom isometric view of the example headwear of FIG. 1 including a clasp in accordance with one or more embodiments of the present disclosure.

A headband (illustrated in FIG. 3, which shows a bottom isometric view of the hat 100) may extend around at least a portion of the circumference of the crown 104 (e.g., along a bottom edge of the crown). Turning now to FIG. 3, a headband 202 and an interior of the crown 104 of headwear 100 of FIG. 1 are shown. The headband 202 may form an extension of the brim 102 and/or a junction between the crown and the brim 102. The headband may extend around at least a portion of the circumference and/or perimeter of the base of the crown. For example, headband 202 may be formed from a substantially rectangular panel that is continuous around the circumference of the crown and/or that includes terminating ends that are joined to or spaced from one another.

In the example illustrated in FIG. 3, terminal ends of the chin strap 108 are coupled and/or attached to the hat at an interior region of the crown 104. For example, the terminal ends may be coupled and/or attached to a junction between the headband 202 and an interior surface 204 of the crown 104. In some examples, the terminal ends may be sandwiched between an interior (e.g., crown-facing) surface of the headband 202 and the interior surface 204 of the crown 104. In other examples, the terminal ends may be directed coupled and/or attached to the interior surface 204 of the crown 104, the headband 202, and/or a bottom surface 206 of the brim 102. In still other examples, the terminal ends may pass through the brim 102 and/or crown 104. For example, the terminal ends may be secured to an outer surface 208 of the crown and pass through respective holes in the brim 102 and/or crown 104 to extend around a chin of the wearer.

Although illustrated as a wide-brimmed hat (e.g., with a brim that extends from/around the full circumference of the crown/hat), it is to be understood that the clasp described herein may be utilized and/or incorporated in any suitable hat or other item, such as a baseball-style cap, a visor (e.g., without a crown), a sun hat (e.g., with a wide brim and/or a partial brim that extends around a portion of the circumference of the crown/hat and may include a neck shield extending from a rear portion of the circumference of the crown/hat), a wristband, a belt, a band for an article of clothing (e.g., an adjustable band around a pant leg/gaiter), etc. Other examples of hats in which the features described herein may be incorporated include, without limitation, a charter hat, a sun fedora, a boonie hat, a capotain, a gat, a hardee hat, a homburg, a panama, a sombrero, a sun visor, a top hat, a legionnaire hat, a trilby, a flap hat, and/or any other suitable head covering.

Although illustrated and described as being used with a chin strap in some of the above examples, it is to be understood that the clasp described herein may be utilized for any purpose relating to joining, connecting, coupling, and/or otherwise coordinating portions of a hat or other article of clothing. For example, the clasp described herein may be included in a sizing mechanism. In such an example, the clasp and/or material to which the clasp is connected may extend at least partially around the circumference of a hat and affix to a loop for sizing the hat.

Figure 4:
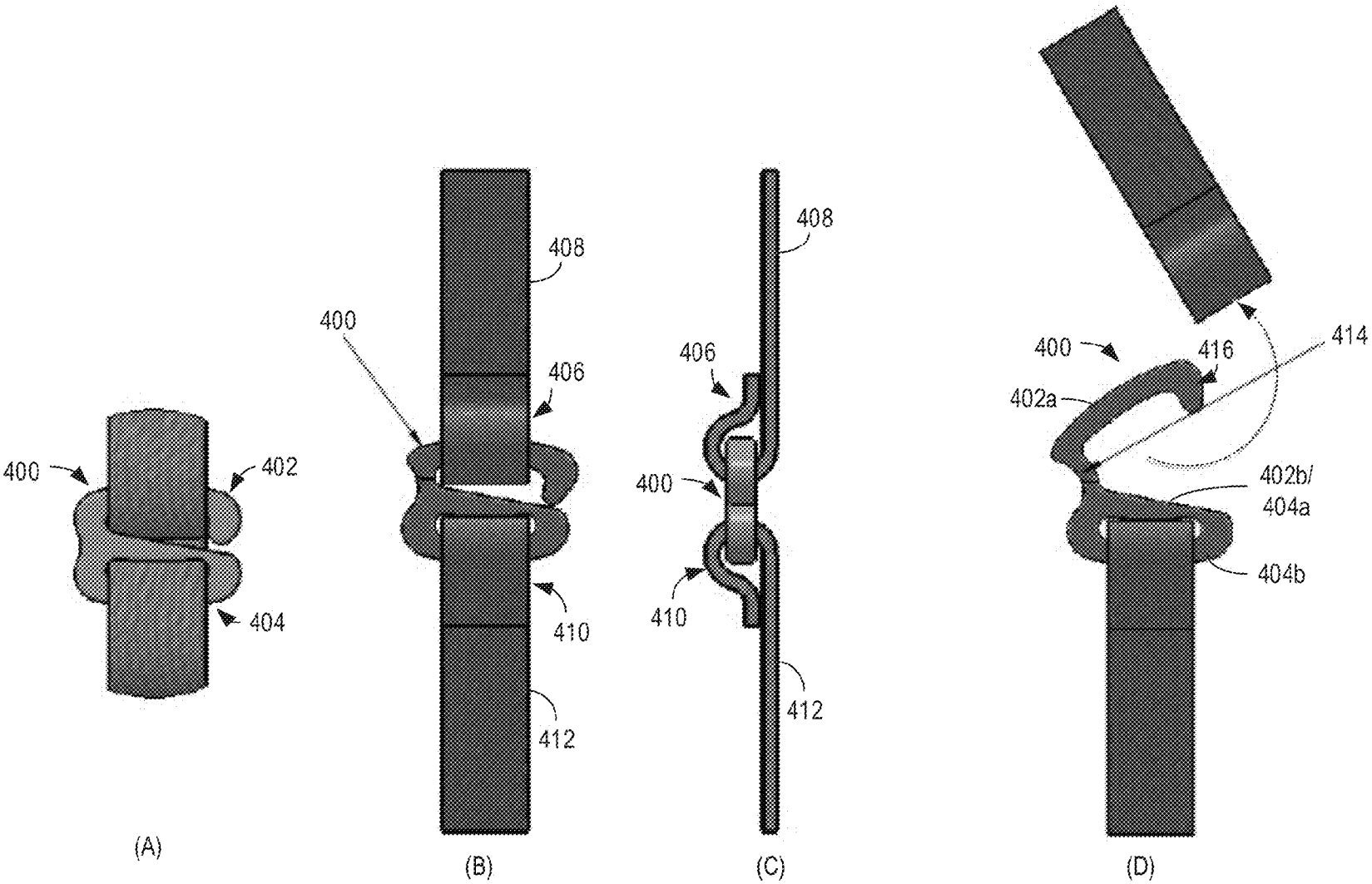
FIG. 4 shows a detailed view of an example clasp in different orientations and states in accordance with one or more embodiments of the present disclosure.

FIG. 4 shows a detailed view of an example clasp 400 in different orientations and states, labelled as views A-D. Clasp 400 may be an example configuration of clasp 110 of FIGS. 1-3. View A is a front view of clasp 400, including an open top loop 402 and a closed bottom loop 404. For example, top loop 402 may be open in that a top leg 402*a* of the loop is at least partially spaced from a bottom leg 402*b* of the loop during a clasping operation in order to allow for insertion into a loop of a terminal end 406 of a first strap 408 of a chin strap (e.g., chin strap 108 of FIGS. 1-3). Bottom loop 404 may be closed in that top leg 404*a* (e.g., which may also serve as bottom leg 402*b* of the top loop 402) is continuously and/or integrally formed with bottom leg 404*b* to form an anchor for the chain strap/clasp. The bottom loop 404 may be sized based on the material used for the chin strap and/or for the clasp, and/or based on an application of the clasp (e.g., whether it is used in a child's hat or an adult's hat). In order to couple a loop of a terminal end 410 of a second strap 412 into this bottom loop 404, the terminal end 410 may be passed through the opening of loop 404, then secured back onto itself, forming the illustrated strap loop. Accordingly, in use, a wearer may only clasp the chin strap through insertion of the clasp into one of the terminal end loops, whereas the other of the terminal end loops may be substantially permanently attached to the clasp.

While view A shows a front view of the clasp 400 where the spaced-apart legs of the top loop 402 during insertion of the clasp into the terminal end of the strap, view B shows a rear view of the clasp 400 after the clasp leg has been inserted into the terminal end and the legs of the top loop 402 are adjacent one another. In some examples, the spaced-apart legs may be ever-present in order to increase ease of insertion/removal of the clasp leg into the terminal end of the strap. In other examples, the adjacent legs illustrated in view B may be achieved via an elastomeric material or region of the clasp in order to provide additional security of the terminal end within the loop of the clasp.

View C shows a side view of the clasp 400 and the inserted terminal ends 406 and 410 of straps 408 and 412, respectively. As shown, the looped terminal ends are formed by attaching the terminal end to a higher/lower point along the strap. In some examples, one or both of the straps may be adjustable by moving the location at which the terminal end(s) attach back to the strap. For example, the chin strap may be tightened by pulling the terminal end of strap 408 upward (when the strap is in the orientation illustrated in view C) and/or toward the crown of the hat/toward a top of the wearer's head. The chin strap may additionally or alternatively be tightened by pulling the terminal end of strap 412 downward (when the strap is in the orientation illustrated in view C) and/or away from the crown of the hat/toward the wearer's feet (or around the wearer's chin toward an opposite side of the hat).

View D shows a breakaway state of the clasp 400. For example, responsive to a threshold amount and/or angle of force placed on the clasp and/or on the straps relative to one another, the clasp may be configured to separate in order to release the chin strap. As illustrated in view D, the bottom loop 404 of the clasp 400 may stay substantially unchanged in the face of such forces. However, the top leg 402*a* of the top loop 402 may be rotated and pulled away from the bottom leg 402*b* of the top loop 402 (e.g., at a hinge 414 opposite hook 416) in order to allow the strap 408 to be released from the clasp. The hinge 414 may be configured to be resilient to different amounts and/or angles of force based on an application of the clasp (e.g., a type of hat being worn, a type of wearer of the hat, an activity in which the hat is being worn, a location of the chin strap, a type of article including the clasp [e.g., other than a hat], etc.). For example, the clasp may be composed of different material types and/or have different dimensions that is based on typical forces that are applied to the objects being joined by the clasp. In the illustrated example, the clasp joins two portions of a chin strap, so the clasp may be dimensioned (e.g., include certain relative thickness and/or types of materials in particular regions) to enable the clasp to resiliently bend or twist responsive to a range of forces and force directions associated with normal disconnections of the strap (e.g., to twist the hook to allow the terminal end 406 to be slid off of the hook), and to break responsive to a range of forces and force directions associated with other disconnections of the strap (e.g., movement within a threshold distance of a longitudinal axis of the chin strap when worn). In some examples, the hook 416 may not be present (e.g., the top leg 402 may extend in an inverted c-shape without the illustrated angular change toward the terminal end of the top leg). In additional or alternative examples, the top leg 402 may have an increased or decreased amount of arching in a middle region in order to accommodate different strap types.

Figure 5:
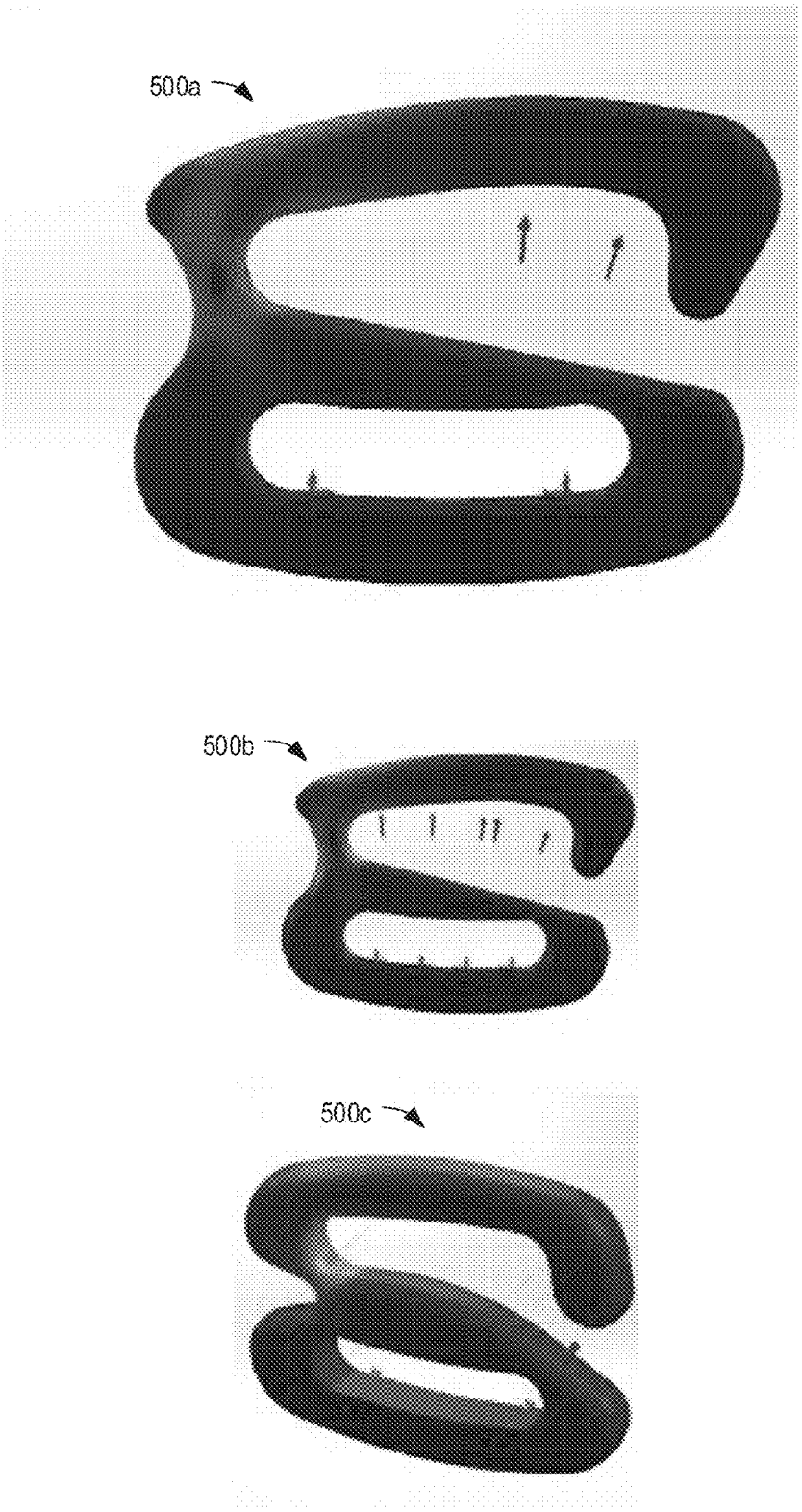
FIG. 5 shows an analysis of the reaction of an example clasp to different forces in accordance with one or more embodiments of the present disclosure.

FIG. 5 shows an analysis of the reaction of an example clasps 500*a*-500*c* to different forces in accordance with one or more embodiments of the present disclosure. For example, clasps 500*a-c* may be examples of clasp 110 of FIGS. 1-3 and/or clasp 400 of FIG. 4. The different colors along the surface of clasps 500*a-c* in FIG. 5 show different levels of breakaway force to which the clasp is configured to withstand. For example, the clasp may provide a lighter or stronger breakaway force depending on the application of the clasp. FIG. 5 shows a finite element analysis (FEA) to determine the reaction (indicated by the different colors) of different regions of the clasp to different forces (indicated by the arrows). The FEA evaluates the strength of material in its form. The analysis may be used to dial in the correct breakaway required for that material and adjust the shape and cross section to match the needs of that specific material. A material similar to Acetal may be used in one example. Additionally or alternatively, additives including but not limited to glass fiber, glass beads, nano tubes, carbon fiber, and/or other materials may be used to attain the targeted strength in a preferred cross section as analyzed by the FEA.

As illustrated in FIG. 5, the blue regions (e.g., the majority of the clasp) are not very susceptible to breaking in the face of the illustrated forces, whereas the green, yellow, and red areas are more susceptible, in that order. Such a differential response to the application of forces may be achieved by forming the clasp of different materials in different regions, as well as by the shape/structure of the clasp, as illustrated. For example, the clasp may be composed of acetal or a similar polymer, such that the plastic clip formed by a top portion of the clasp (e.g., the top leg 402*a* of the clasp 400 in FIG. 4) may break away at predetermined loads based on the angle of the force applied to the clasp. The different thicknesses of material at different regions of the clasp also affect the breakaway patterns and susceptibility, as shown in the different examples of clasps 500*a-c*.

Figure 6:
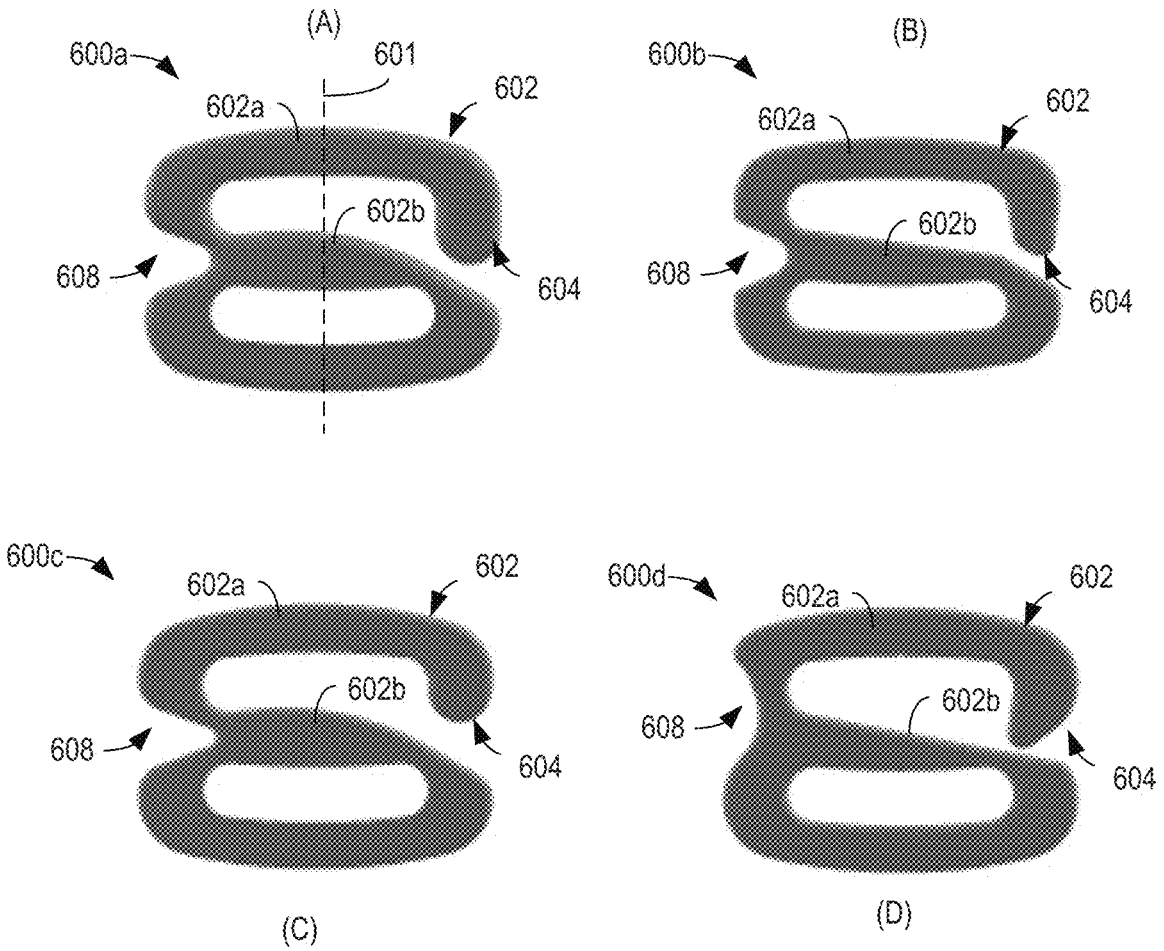
FIG. 6 shows different possible structures for example clasps in accordance with one or more embodiments of the present disclosure.

FIG. 6 shows different possible structures for example clasps 600A-D in accordance with one or more embodiments of the present disclosure. For example, each structure illustrated in FIG. 6 may provide a different breakaway performance (e.g., may breakaway at different ranges of forces and/or for different angles of force) for the S-shaped or Z-shaped clasp having a center axis 601 (only illustrated for 600*a* for clarity purposes). For ease of illustration and reference, similar regions of each different structure will be provided with the same reference numeral, despite having a different shape/configuration. In each of the structures, a ramp including at least a portion of substantially linear declination is provided in a middle region of the clasp. Structures A and C show examples where the middle region (e.g., a bottom leg 602*b* for a top loop 602 of the clasp) is raised in the center (e.g., with an incline, peak, then decline along the upper surface of the bottom leg) and tapers off toward a location of a terminal/spaced end 604 of the respective top leg 602*a* of the top loop 602 of the clasp (e.g., a catch end 604). In structure B, the bottom leg 602*b* has a substantially linear decline along a first portion of the upper surface of the bottom leg, then a sharp increase in the declination upon reaching the location of the terminal/spaced end 604 of the respective top leg 602*a*. In structure C, the bottom leg 602 has a substantially linear declination along the entirety of the top surface.

Other differences between the structures include an inward-facing terminal end 604 of the top leg 602*a*/hook and a shallower depression along the side opposite the terminal end 604 in structure D relative to the other structures. As a result, the thinnest point of a hinge 608 in structure D is higher and further to the side of the clasp than the corresponding points of hinge 608 in structures A-C.

Figure 7:
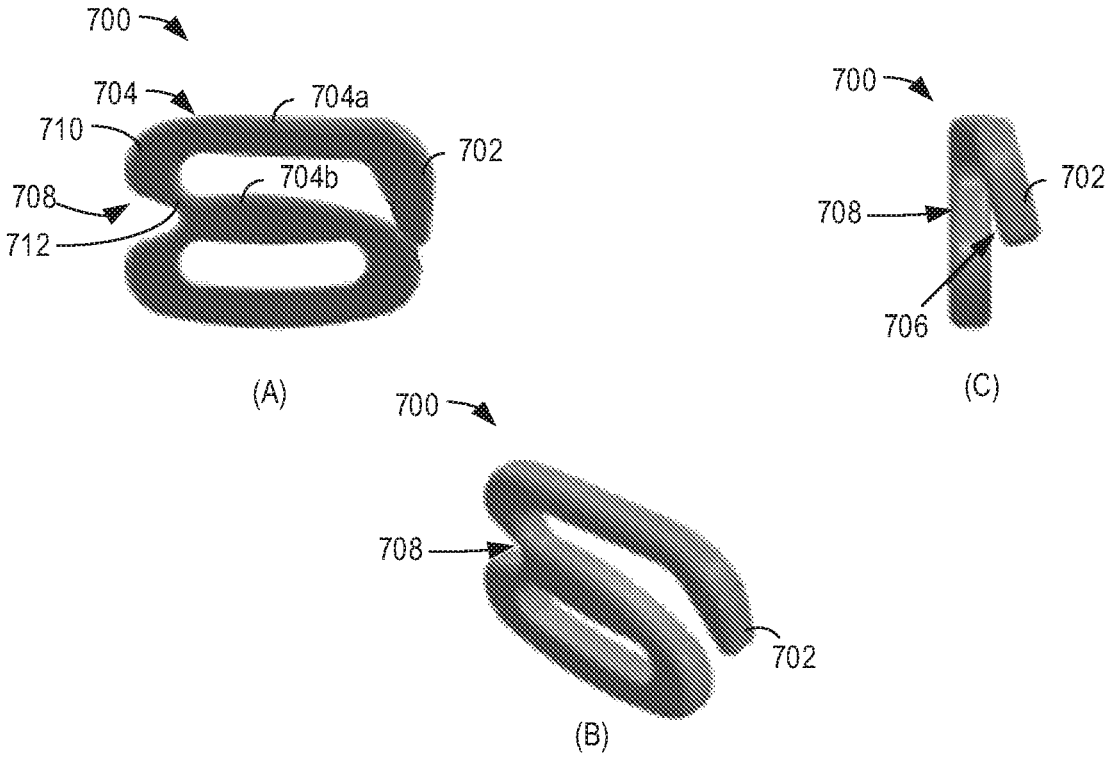
FIG. 7 shows front, isometric, and side views of an example clasp while a force is applied to a region of the clasp in accordance with one or more embodiments of the present disclosure.

FIG. 7 shows front (A), isometric (B), and side (C) views of an example clasp 700 while a force is applied to a region of the clasp in accordance with one or more embodiments of the present disclosure. Clasp 700 may be an example of any of the above-described clasps. As shown, clasp 700 includes an offset hook 702 formed from a top leg 704*a* of a top loop 704 of the clasp. The overlap of the hook over a bottom leg 704*b* of the top loop 704 of the clasp may serve to retain a chin strap therein to avoid unintentional release of the strap. A force applied to the hook 702 may result in the bending or twisting of the hook shown in the side view C. For example, as shown in side view C, a tip 706 of the hook is twisted so as to be unaligned with a hinge 708 or otherwise displayed to the side relative to the top leg 704*a*. In other words, instead of extending straight downward at an approximately right angle from the top leg 704*a* (e.g., from a longitudinal axis of the top leg), the twisting of the hook 702 causes the tip 706 to have a different azimuth relative to a central point of the clasp 700 than in a state at which the hook is not exposed to bending or twisting forces. The tip of the hook may be composed of a material that enables the tip to rotate, twist, or otherwise change azimuth relative to the central point of the clasp to one or more biasable positions (e.g., two or more biasable positions on opposing sides of the hinge 708 responsive to a first range of forces or tension applied to the hook, and to break responsive to a second, higher range of forces applied to the hook. Such an elastic capability may allow a user to displace the hook to allow insertion of a loop of material (e.g., a chin strap terminal end). The hook may be biased to a closed position aligned with the bottom leg 704, such that the hook snaps back to such a position after insertion of the chin strap in order to retain the chin strap therein.

As shown, the hinge 708 may be composed of a thinner material and/or include different material relative to remaining portions of the clasp 700. The top leg 704*a* may extend to the hook 702 at a first terminating end of the top leg, and to a top hinge portion 710 at a second, opposing terminating end of the top leg. The top hinge portion 710 may be thicker (e.g., have a thicker diameter) than a bottom hinge portion 712, and the bottom hinge portion 712 may be thinner (e.g., have a thinner diameter) than the bottom leg 704*b*. In some examples, the bottom hinge portion 712 may include different material than the top hinge portion 710. In additional or alternative examples, one or both of the top and bottom hinge portions 710 and 712 may include the same or different material than remaining areas of the clasp 700.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The description of embodiments has been presented for purposes of illustration and description. Suitable modifications and variations to the embodiments may be performed in light of the above description. The described example headwear are exemplary in nature, and may include additional elements and/or omit elements. The subject matter of the present disclosure includes all novel and non-obvious combinations and sub-combinations of the various structures and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A clasp, comprising:

a top loop having a catch end;

a bottom loop coupled to the top loop, the catch end positioned above the bottom loop at a first side of the clasp; and a depression at a second side of the clasp, opposite the first side relative to a center axis of the clasp that extends from the top loop to the bottom loop, a thinnest part of the second side of the clasp being formed by the depression, wherein the depression has a thickness along a lateral first axis, parallel to a longitudinal axis of the top loop and perpendicular to the center axis, which is the thinnest part of the second side of the clasp; and wherein the depression is formed on an outer perimeter surface of the top loop at the second side of the clasp, and wherein the depression has a width along a second axis, orthogonal to the central axis and the longitudinal axis, that is a same width as a width of the bottom loop.

2. The clasp of claim 1, wherein the top loop is an open loop such that a gap is formed between the catch end and the bottom loop at the first side of the clasp.

3. The clasp of claim 1, wherein the bottom loop is a closed loop.

4. The clasp of claim 1, wherein the bottom loop is coupled to the top loop at the second side of the clasp.

5. The clasp of claim 1, wherein the top loop includes a top leg that extends from the second side of the clasp to the first side of the clasp at a first angle relative to the center axis, and wherein the catch end extends from the top leg at a second angle relative to the center axis, different than the first angle.

6. The clasp of claim 1, wherein:

the top loop includes a top leg, the catch end, a top hinge portion opposite the catch end relative to the center axis, and a bottom leg; and the bottom leg forms a portion of the bottom loop.

7. The clasp of claim 6, wherein at least part of a top surface of the bottom leg has a linear declination.

8. The clasp of claim 6, wherein the depression is thinner than the bottom loop.

9. Headwear, comprising:

a crown;

a strap extending from the crown, the strap including two strap portions extending from different locations of the crown; and a clasp coupled to the strap at a first terminal end of a first strap portion of the two strap portions, the clasp having a top loop having a catch end, a bottom loop coupled to the top loop via a middle region, the catch end positioned above the bottom loop at a first side of the clasp relative to a center axis, wherein the clasp further includes a depression at a second side of the clasp, opposite the first side relative to the center axis, a thinnest part of the second side formed by the depression, wherein the clasp includes an outer perimeter surface that extends along the top loop, the second side, and the bottom loop, and the outer perimeter surface curves inward on the second side toward the middle region of the clasp to form the depression, wherein the depression has a thickness from the outer perimeter surface to an inner perimeter surface of the top loop, wherein the thickness is the thinnest part of the second side, and wherein the inner perimeter surface forms and faces an opening configured to accommodate a second strap portion of the two strap portions.

10. The headwear of claim 9, wherein the first terminal end is coupled to the clasp at the bottom loop of the clasp, and wherein the top loop is configured to removably engage a second terminal end of the second strap portion of the two strap portions.

11. The headwear of claim 9, wherein the thinnest part of the second side defines a hinge of the clasp, the hinge being configured to resiliently bend when exposed to a first range of forces at a first range of angles.

12. The headwear of claim 11, wherein the hinge is configured to break when exposed to a second range of forces at the first range of angles.

13. A clasp, comprising:

a top loop having a catch end;

a bottom loop coupled to the top loop, the catch end positioned above the bottom loop at a first side of the clasp; and a depression at a second side of the clasp, opposite the first side, a thinnest part of the second side of the clasp being formed by the depression and defining a hinge configured to resiliently bend when exposed to a first range of forces at a first range of angles, wherein the depression is located on an opposite side of the clasp as the catch end relative to a center axis that extends from the top loop to the bottom loop, and the depression has a thickness along a first axis, perpendicular to the central axis and parallel to a longitudinal axis of the top loop, which is the thinnest part of the second side of the clasp.

14. The clasp of claim 13, wherein the thinnest part of the second side of the clasp is located at a bottom hinge portion of the top loop that couples to a middle region of the clasp.

15. The clasp of claim 13, wherein the top loop is an open loop such that a gap is formed between the catch end and the bottom loop at the first side of the clasp.

16. The clasp of claim 13, wherein the top loop includes a top leg having a top surface that extends from the second side of the clasp to the first side of the clasp at a first angle relative to the center axis, and wherein the catch end has an outer surface that extends from the top surface toward the bottom loop at a second angle relative to the center axis, different than the first angle.

17. The clasp of claim 16, wherein the catch end has an inner surface that extends from a bottom surface of the top leg toward the bottom loop at least partially at a third angle relative to the center axis, different than the second angle.

18. The clasp of claim 13, wherein the hinge is configured to break when exposed to a second range of forces at the first range of angles.

* * * * *